United States Patent [19]

Matsushita

[11] 4,347,554

[45] Aug. 31, 1982

[54] LUMINAIRE

[75] Inventor: Nobuo Matsushita, Tokyo, Japan

[73] Assignee: Toshiba Electric Equipment Corporation, Tokyo, Japan

[21] Appl. No.: 188,491

[22] Filed: Sep. 18, 1980

[30] Foreign Application Priority Data

Sep. 21, 1979 [JP] Japan ..... 54-122410

[51] Int. Cl.[3] ..... F21V 7/00

[52] U.S. Cl. ..... 362/297; 362/263; 362/346; 362/348

[58] Field of Search ..... 362/2, 263, 296, 297, 362/305, 307, 346, 348, 350; 427/376 A, 295

[56] References Cited

U.S. PATENT DOCUMENTS

| | | | |
|---|---|---|---|
| 3,401,258 | 9/1968 | Guth | 362/296 |
| 3,499,780 | 3/1970 | Etnerington | 427/326 A |
| 3,662,165 | 5/1972 | Osteen | 362/297 |
| 3,950,638 | 4/1976 | Kent | 362/297 |
| 4,081,667 | 3/1978 | Lewin | 362/296 |
| 4,225,908 | 9/1980 | Small | 362/2 |

*Primary Examiner*—Donald P. Walsh
*Attorney, Agent, or Firm*—Oblon, Fisher, Spivak, McClelland & Maier

[57] ABSTRACT

A luminaire includes a light source and a reflector for reflecting light emitted by the light source in desired directions.

The reflector includes a first region having a smooth reflecting surface and a second region having a plurality of reflecting surface units each having opposite side slanted portions. Each of said regions is constructed by a multi-layer structure. The structure includes a base member, a high reflecting film deposited on the base member, and a transparent protective film deposited on the high reflecting film.

16 Claims, 10 Drawing Figures

LUMINAIRE

BACKGROUND

1. Field of the Invention

This invention relates to luminaires or illuminating devices and, more particularly, to floodlights.

2. Description of the Prior Art

As a luminaire of this kind, those using a high reflector are well known in the art. The high reflector is fabricated by forming a high purity aluminum member having a paraboloidal shape and then effecting electrolyric polishing and anodic oxidation on it or effecting chemical polishing on it, followed by immersing it in borosilicate glass and a subsequent baking treatment. Efforts have hitherto been paid to increasing the luminaire efficiency using such a high reflector. The approaches are roughly classed into three methods.

SUMMARY OF THE INVENTION (i) To increase the size of the reflector.

(ii) To obtain the most effective reflector shape within the limited size.

(iii) To use a reflector material of high reflectance and high specularity.

By method (i), the increase of the material used and the weight is inevitable, and also the cost increase is prone. Further, thereof handling is inconvenient. Regarding method (ii), nearly the upper limit of the luminaire efficiency has been achieved as the result of research and development for the past several years. By method (iii), new materials and new surface treatment processes are used. In this case, however, it is necessary to determine the shape of the reflector by fully considering the reflectance, specularity, etc. that can be achieved with the new materials and new surface treatment processes. In other words, when the new materials or processes are directly applied to a reflector having a most efficient well-known shape that reflector cannot yield excellent performance. For example, the use of a reflector material of high reflectance and high specularity for the reflector of a conventional high efficiency narrow angle foodlight results in an extremely high axial luminous intensity and hence in a too narrow one-tenth-peak spread.

The primary object of the invention is to obtain a predetermined luminous intensity distribution while obtaining a high efficiency compared to the prior-art by using a reflector of the same size as in the prior-art, that is, to provide a luminaire, which has a coated reflecting surface and permits the suppression of the undesired increase of the axial luminous intensity in case of using a reflector capable of achieving a high reflectance and a high specularity as well as permitting a high beam efficiency and a high luminaire efficiency to be obtained.

This invention can be more fully understood from the following detailed description when taken in conjunction with the accompanying drawings, in which.

DETAILED DESCRIPTION OF THE PREFERRED EMBODIMENT

The embodiment of this invention is explained in connection with the accompanying drawings.

Figure 1:
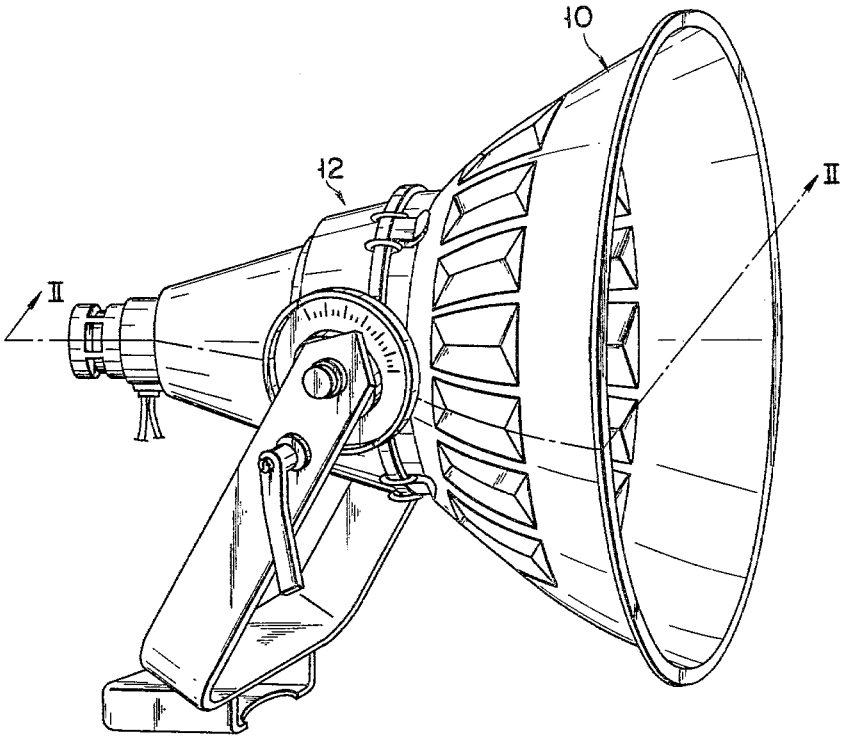
FIG. 1 is a perspective view showing an embodiment of the luminaire according to the invention.
Figure 2:
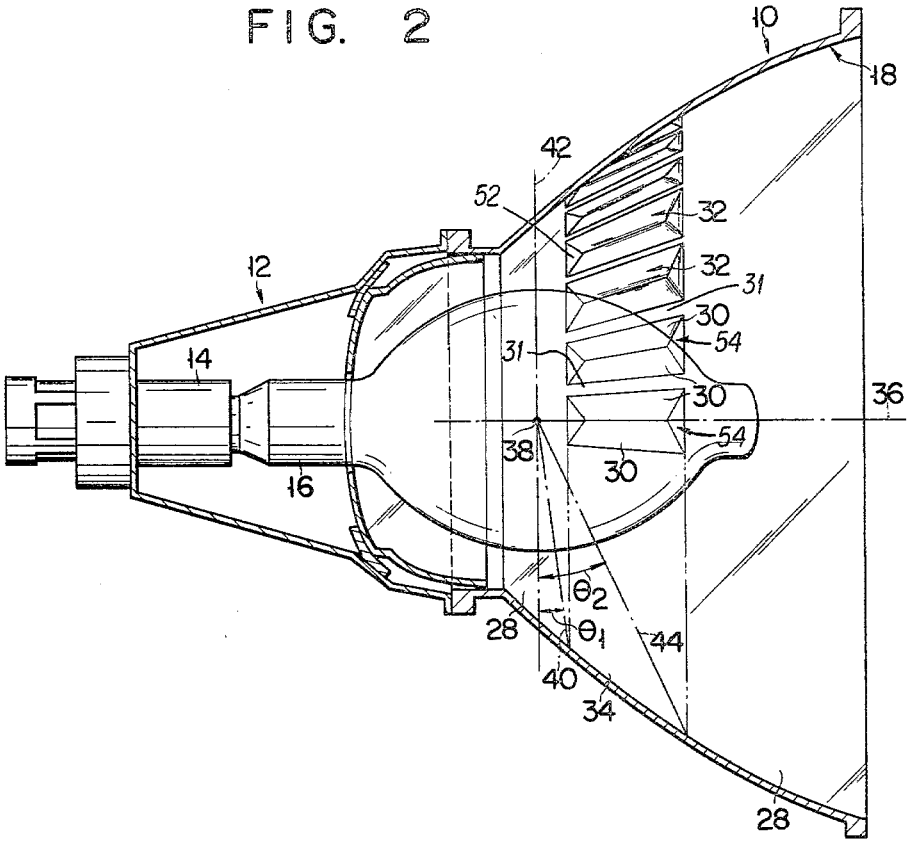
FIG. 2 is a sectional view taken along line II—II in FIG. 1.

FIG. 1 shows a luminaire, which is a floodlight provided with a reflector 10 removably supported in a reflector support 12. As shown in FIG. 2, the reflector support 12 is provided with a light source holding mechanism 14 supporting a light source 16. In this embodiment, the light source holding mechanism 14 is a socket electrically connected to an external power source (not shown), and the light source 16 is a high pressure mercury lamp, a variety of the high intensity discharge lamp. As the light source 16 it is also possible to use a high pressure sodium lamp or a metal halide lamp.

The reflector 10 has a desired curved surface; in this embodiment it has a quadratic surface of revolution. It is flared from its rear end toward its front end. As is shown in FIG. 2, the reflector 10 faces the light source 16 and reflects light emitted therefrom in desired directions.

Figure 3:
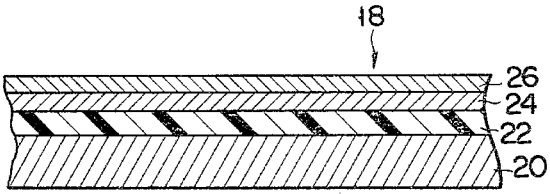
FIG. 3 is an enlarged-scale sectional view showing a portion of a reflector in FIG. 2.

The reflecting surface 18 of the reflector 10 is as shown in FIG. 3, including a base member 20 including such metal as aluminum or stainless steel. In this embodiment, the base member 20 is provided with an undercoat 22 consisting of a heat-resistant resin. In this embodiment, the heat-resistant resin is silicon. The reflecting surface 18 further includes a high reflecting film 24 which is constructed by vacuum evaporation deposition of aluminum on the undercoat 22. It still further includes a transparent protective film 26 which is constructed by vacuum depositing a material formed of inorganic formation on the high reflecting film 24. In this embodiment, the material formed of inorganic formation is quartz glass ($SiO_2$) or silica glass. In this embodiment, the undercoat 22 has the effects of increasing the adhesion of the high reflecting film 24 to the base member 20 and also increasing the smoothness of the surface of the high reflecting film 24. This means that the specurality of the surface of the transparent protective film 26, i.e., the specularity of the reflecting surface 18 of the reflector 10, is improved compared to the prior-art. The undercoat 22 is not an essential constituent element, and may thus be omitted. The base member 20, high reflecting film 24 and transparent protective film 26 form a multi-layer structure.

The total reflectance of the reflecting surface 18 having the aforementioned multi-layer structure is as high as about 1.1 times the total reflectance of the prior-art reflecting surface which is obtained by electrolyric polishing a high purity aluminum followed by an anodic oxidation film formation treatment. It is also proved by the comparison of the specularities of the former and latter reflecting surfaces with 20 degrees gloss defined in JIS (Japanese Industrial Standard) Z8741 as reference that the specularity of the former is as high as about 1.5 times that of the latter.

Further, the total reflectance of the reflecting surface 18 having the aforementioned multi-layer structure is as high as about 1.05 times that of a prior-art reflecting surface which is obtained by chemical polishing high purity aluminum followed by immersion thereof in borosilicate glass and subsequent baking thereof. In this case, the comparison of the specularities of the former and latter reflecting surfaces with the aforementioned 20 degrees gloss as reference shows that the specularity of the former is as high as about 1.5 times that of the latter.

Figure 4:
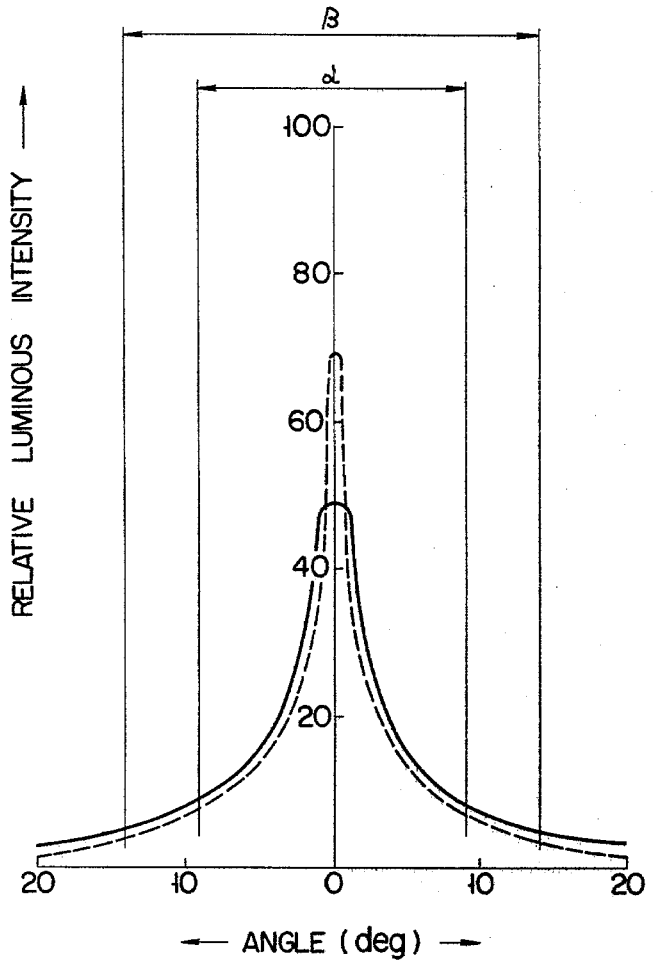
FIG. 4 is a graph with a solid curve showing the luminous intensity distribution curve of an embodiment of the luminaire according to the invention and a dashed curve showing the luminous intensity distribution curve of a prior-art luminaire which does not have the reflecting surface units that are present in the embodiment of the invention.
Figure 5:
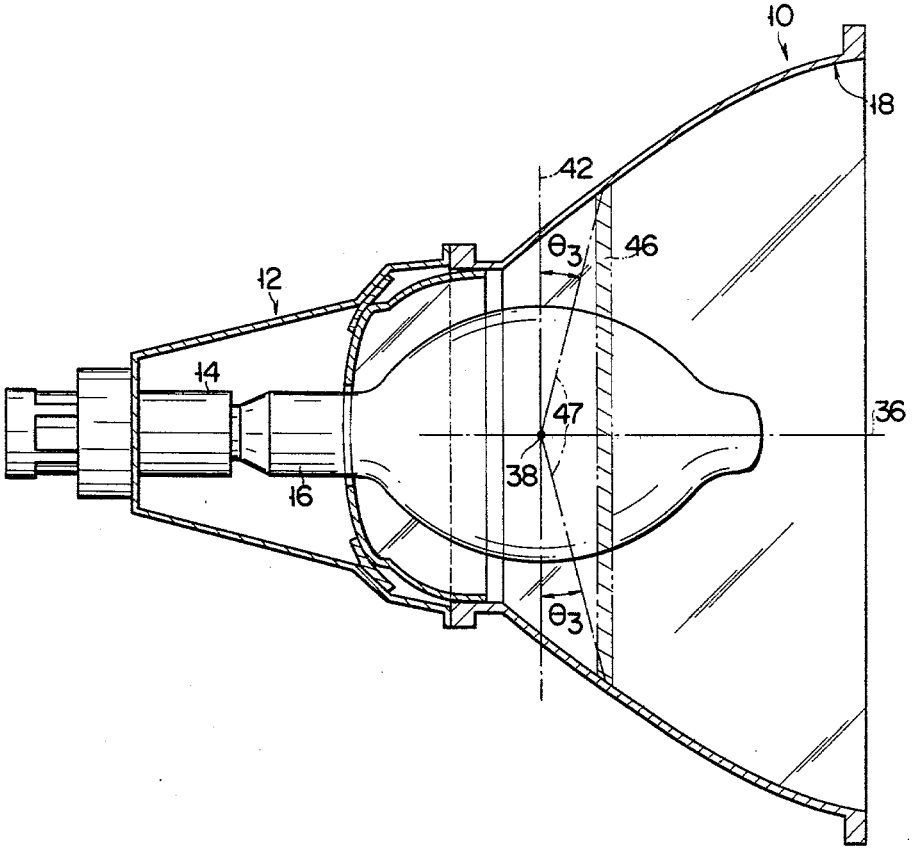
FIG. 5 is a sectional view similar to FIG. 2 but showing a prior-art luminaire not having the reflecting surface units in the embodiment of the luminaire according to the invention.

In FIG. 4, a dashed curve represents the luminous intensity distribution obtained when the reflecting surface 18 having the aforementioned multi-layer structure, with which the total reflectance and specularity are improved compared to the prior-art, to a conventional floodlight as shown in FIG. 5, which is said to be a narrow angle floodlight with the one-tenth-peak spread ranging from 20° to 30°. In this case, the axial luminous intensity is higher than that obtained with the aforementioned prior-art reflector by 20 to 40%. Also, the one-tenth-peak spread $\alpha$ is less than 20°. Since the aforementioned dashed curve representing the luminous intensity distribution is very sharp in shape, the use of a floodlight provided with a reflector having this luminous intensity distribution curve can hardly considered in the illumination design; that is, the application of the floodlight provided with the reflecting surface of this luminous intensity distribution curve is limited.

In order to preclude this drawback, the reflector 10 of this embodiment is formed such that its reflecting surface includes two first regions 28 constituted by respective smooth surface portions of the aforementioned desired curved surface adjacent to the rear and front ends thereof and a second region 34 intervening between these first regions 28 and provided with a plurality of reflecting surface units 32, as clearly shown in FIg. 2. Each of these reflecting surface units 32 has opposite side slanted portion 30 slanted from the intersection line thereof and a smooth reflecting surface 31 defined between adjacent reflecting surface units 32.

Figure 6:
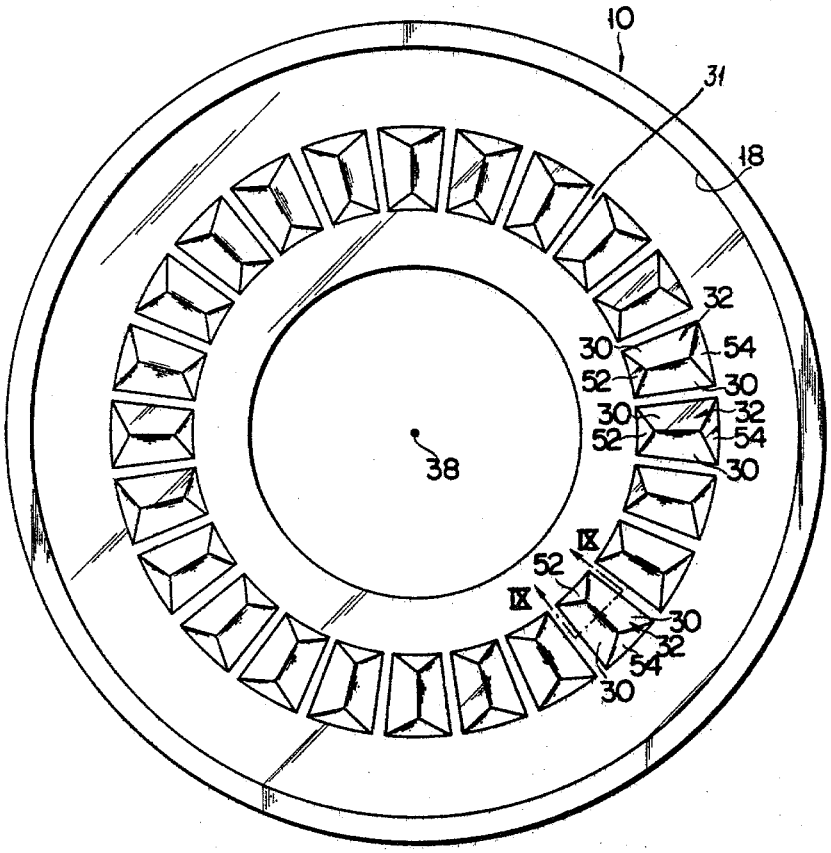
FIG. 6 is a front elevational view of the reflector of the luminaire of FIG. 1.

The plurality of reflecting surface units 32 are arranged at a uniform interval in an annular arrangement in their projection to a plane crossed the axis 36 of the reflector 10 at a right angle, as clearly shown in FIG. 6, which is a front elevational view of the reflector 10. Also, the intersection lines of the opposite side slanted portions 30 in the individual slanted reflecting surface units 32 are in a radial arrangement when the reflector 10 is viewed from the front side as shown in FIG. 6.

As shown in FIG. 2, one end of each of the reflecting surface units 32 is located such that a first straight line segment 40 connecting this end and the light center 38 of the light source 16 makes an angle $\theta_1$ of 10° with a reference plane 42 perpendicular to the axis of the reflector 10 and containing the optical center 38. Also as shown in FIG. 2, the other end of each of the reflecting surface units 32 is located such that a second straight line segment 44 connecting this end and the light center 38 of the light source 16 makes an angle $\theta_2$ of 30° with the reference plane 42.

Figure 7:
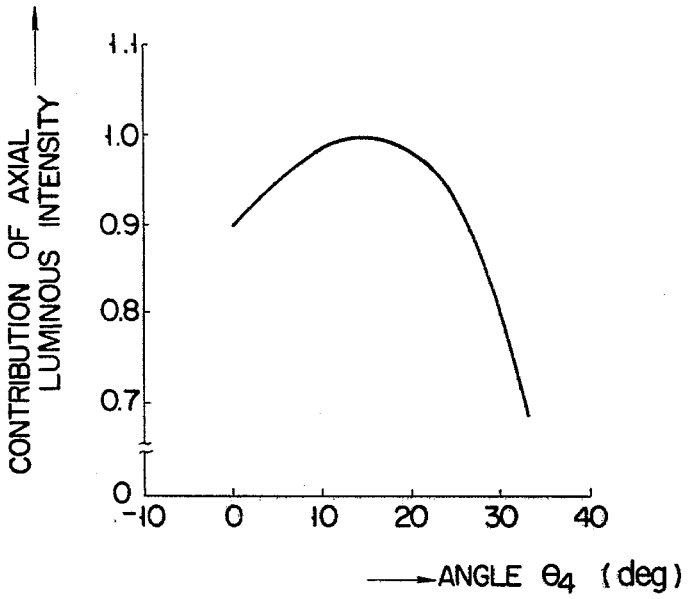
FIG. 7 is a graph showing the contribution of the axial luminous intensity plotted against the angle $\theta_3$ shown in FIG. 5.

The aforementioned angles $\theta_1$ and $\theta_2$ are set in the following way. The inventor has experimentally studied in detail the path of light emitted from the light source 16 when the reflecting surface 18 of the aforementioned multi-layer structure is applied to the conventional narrow angle floodlight as a result of characteristic as shown in FIG. 7 could have been obtained. This characteristic represents the contribution factor of light reflected from a infinitesimal surface area 46 of the reflecting surface 18 to the axial luminous intensity. The position of the infinitesimal surface area is shown in terms of the angle $\theta_3$ between the straight line segment 47 connecting the infinitesimal surface area 46 and the light center 38 and the reference plane 42. The study of this characteristic shows that the contribution factor is maximum in the neighborhood of $\theta_3=15°$. The shape and location of the reflecting surface units 32 are determined by obtaining the path of light reflected from the reflecting surface 18 through calculations with $\theta_3=15°$ taken as the center. It is found that the angle $\theta_1$ preferably ranges from about 0° to about 15° and is most preferably 10°, which is the gist of the invention. Also it is found that the angle $\theta_2$ preferably ranges from about 20° to about 30° and is most preferably 30°, which is again the gist of the invention.

Figure 8:
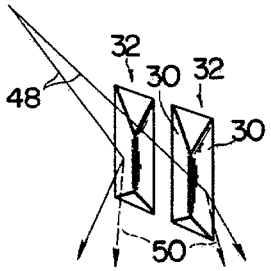
FIG. 8 is an enlarged-scale view showing reflecting surface units for illustrating the function thereof.

With the above construction, incoming beams 48 emitted from the light source 16 and incident on each reflecting surface unit 32 is reflected by the opposite side slanted portions 30 thereof, as shown in FIG. 8. Of the reflected beams from the slanted portions 30, the components normal to the axis of the reflecting surface unit 32 are dispersed as resultant beams in obliquely forward directions as shown by solid lines in FIG. 8. In FIG. 8, dashed lines indicate the reflected beams in the case of the absence of the reflecting surface units 32. With the slanted portions 30 provided, the reflected beams are more slanted than the reflected beams 50 in the case of the absence of these slanted portions 30. Thus, it is possible to obtain the luminous intensity distribution curve as shown by the solid line curve in FIG. 4. The one-tenth-peak spread $\beta$ of this luminous intensity distribution curve ranges from 20° to 30°, and this coincides with that required for the aforementioned narrow angle floodlight. With the luminous intensity distribution curve of the solid curve the beam efficiency is higher than with the luminous intensity distribution curve of the dashed line curve. In addition, since the reflector 10, with which it is possible to obtain the luminous intensity distribution curve of the solid line curve, has the aforementioned multi-layer structure as the reflecting surface 18, the luminaire efficiency of this reflector 10 is high compared to the aforementioned prior-art reflectors having the various reflecting surface structures.

Figure 9:
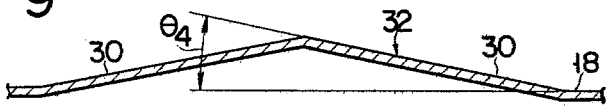
FIG. 9 is an enlarged-scale sectional view taken along line IX—IX in FIG. 6.

It is found that, as shown in FIG. 9, the angle $\theta_4$ of the intersection between the slanted portion 30 and the aforementioned curved surface preferably ranges from about 10° to about 15° and is most preferably 10°, which also is the gist of the invention. It is also the gist of the invention that, as shown in FIGS. 2 and 6, the plurality of reflecting surface units 32 each further include a first auxiliary slanted surface 52, which is found at the aforementioned one end and is slanted therefrom toward the intersection line between the opposite side slanted portions 30, i.e., toward the aforementioned front end of the reflector, and also a second auxiliary slanted surface 54, which is found at the aforementioned other end and is slanted therefrom toward the intersection line, i.e., the aforementioned rear end of the reflector.

It is to be mentioned here that if the aforementioned ranges of the angles $\theta_1$ and $\theta_2$ are exceeded so that the reflecting surface units 32 cover substantially the entire reflecting surface 18, the axial luminous intensity that is required for the narrow angle floodlight can no longer be obtained. Also, in this case the one-tenth-peak spread is excessive, and the luminous intensity distribution curve of what is called a medium angle floodlight one-tenth-peak spread of 30° to 70° results. In this case, therefore, it is difficult to efficiently illuminate a limited area from a remote position.

As has been described in the foregoing, the luminaire according to the invention includes a light source and a reflector for reflecting flux emitted therefrom in desired directions, the reflector including a desired curved surface, a first region having a smooth reflecting surface and a second region having a plurality of reflecting surface units each having opposite side slanted portions, each of said regions having a multi-layer structure including a base member, a high reflecting film coated on the base member and a transparent protective film coated on the high reflecting film.

Thus, it is possible to obtain a desired luminous intensity distribution while obtaining high beam efficiency and a high luminaire efficiency compared to the prior-art with reflector of the same dimensions as in the prior-art.

It is to be understood that the above embodiment has been given for the purpose of illustration only and is by no means limitative, so that various changes and modifications in the technical details can be made without departing from the scope and spirit of the invention.

Figure 10:
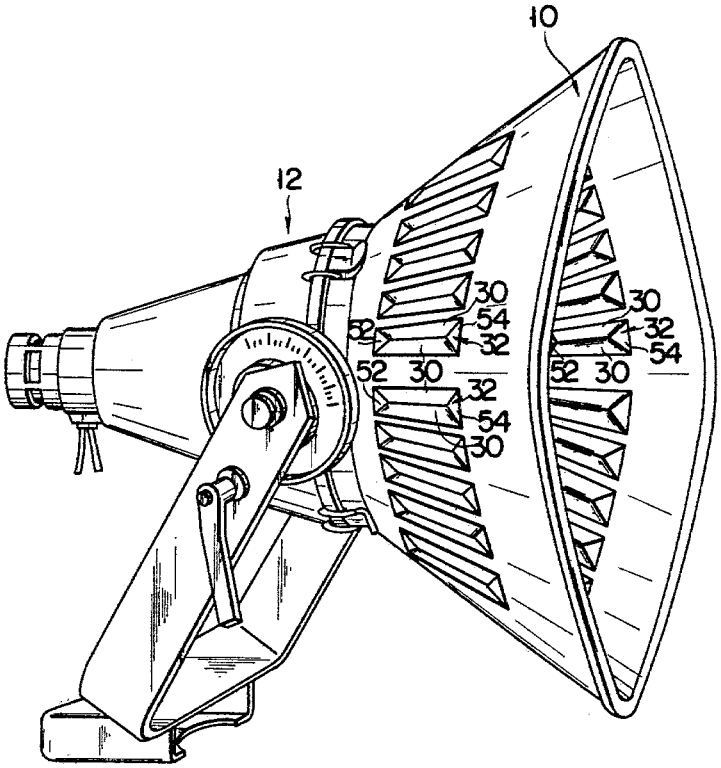
FIG. 10 is a perspective view showing a modification of the embodiment of the luminaire of FIG. 1.

For example, it is possible to a pyramidic shape as shown in FIG. 10 or a hexagonal shape instead of the reflector 10 in FIG. 1 as the desired curve surface.

Also, the reflecting surface units 32 may be spaced apart as in the above embodiment, or they may be continuous to one another. Further, the reflecting surface units 32 and the rest of the reflecting surface 18 may be integral or may be formed separately from each other.

Furthermore, it is possible to form the base member 20 from a plastic material. Further, the high reflecting film 24 may be constructed by vacuum evaporation deposition of silver. Further, the transparent protective film 26 may be constructed by depositing $Al_2O_3$.

What is claimed is:

1. A luminaire comprising:

a light source;

a reflector surrounding the light source and reflecting light emitted by the light source to a desired direction;

said reflector including a first region formed on the inner surface of said reflector, located at first and second places, said first place being located adjacent a light projecting end portion of said reflector and said second place being located adjacent a base end portion of said reflector and each having a smooth reflecting surface; and a second region formed on the inner surface of said reflector disposed between the two places of said first region;

a plurality of substantially identical reflecting surface units positioned in said second region, each having slanted opposite side portions which intersect each other wherein the plurality of reflecting surface units are arranged in a circumferential direction at fixed intervals such that each of said smooth reflecting surface portions are defined between two adjacent reflecting surface units and each connect the first and second places of said first region, wherein a first imaginary straight line segment connecting a first end of the reflecting surface unit and the light center of the light source forms a first fixed angle with a reference plane normal to the axis of the reflector and containing the light center, a second imaginary straight line segment connecting a second end of the reflecting surface unit and the light source which forms a second fixed angle with the reference plane, and wherein said reflector in said first and second regions further comprises a multilayer structure including a base member forming the shape of the reflector, a high reflecting film deposited on the base member, and a transparent protective film deposited on the high reflecting film.

2. A luminaire according to claim 1, wherein the first fixed angle of the first imaginary straight line segment comprises a fixed angle within a range between about 0° and about 15°, and said second fixed angle of the second imaginary straight line segment comprises a fixed angle within a range between about 20° and about 30°.

3. A luminaire according to claim 1, wherein the first fixed angle comprises an angle of 10°, and said second fixed angle comprises an angle of 30°.

4. A luminaire according to claim 1, wherein said slanted opposite side portions intersect with the smooth surface portion of the second region at an angle within a range between about 10° and about 15°.

5. A luminaire according to claim 4, wherein the slanted opposite side portions intersect with the smooth surface portion of the second region at an angle of 10°.

6. A luminaire according to claim 1, wherein the plurality of reflecting surface units each further comprise a first auxiliary slanted surface extending from said first end and slanted therefrom toward the ridge between the slanted opposite side surface and a second auxiliary slanted surface extending from said second end and slanted therefrom toward the ridge.

7. A luminaire according to claim 6, wherein the first fixed angle of the first imaginary straight line segment comprises a fixed angle within a range between about 0° and about 15°, and said second fixed angle of the second imaginary straight line segment comprises a fixed angle within a range between about 20° and about 30°.

8. A luminaire according to claim 7, wherein the first fixed angle comprises an angle of 10°, and said second fixed angle comprises an angle of 30°.

9. A luminaire according to claim 1, wherein said slanted opposite side portions intersect with the smooth surface portion of the second region at an angle within a range between about 15°.

10. A luminaire according to claim 9, wherein the slanted opposite side portions intersect with the smooth surface portion of the second region at an angle of 10°.

11. A luminaire according to claim 1, wherein the shape of the reflector is a quadratic of revolution.

12. A luminaire according to claim 11, wherein the base member comprises metal, the high reflecting film comprises a vacuum deposited aluminum, and the transparent protective film comprises an inorganic material.

13. A luminaire according to claim 12, wherein the said inorganic material comprises silica glass.

14. A luminaire according to claim 1, wherein a transverse section of the reflector taken on an imaginary plane which intersects the axis at an angle of 90° is square.

15. A luminaire according to claim 14, wherein the base member comprises metal, the high reflecting film comprises a vacuum deposited aluminum, and the transparent protective film comprises an inorganic material.

16. A luminaire according to claim 15, wherein said inorganic material comprises silica glass.

* * * * *